US007066820B1

(12) United States Patent
King et al.

(10) Patent No.: US 7,066,820 B1
(45) Date of Patent: Jun. 27, 2006

(54) ILLUSION TOY

(76) Inventors: William L King, 20537 Old Town Rd, Tehachapi, CA (US) 93561; Mark Setteducati, 218 E. 17 St., New York City, NY (US) 10003; Robert Carignan, 7 Ivy Hollow Ct., Cranston, RI (US) 02921; Terry Chan, Unit 905 9F, Greenfield Tower, 1 Science Museum Rd., Kowloon (HK)

( * ) Notice: Subject to any disclaimer, the term of this patent is extended or adjusted under 35 U.S.C. 154(b) by 209 days.

(21) Appl. No.: 10/768,982

(22) Filed: Jan. 30, 2004

Related U.S. Application Data

(60) Provisional application No. 60/533,900, filed on Jan. 2, 2004.

(51) Int. Cl.
*A63J 21/00* (2006.01)

(52) U.S. Cl. ..... 472/69; 472/70; 446/483; 446/475

(58) Field of Classification Search ..... 472/51, 472/54, 55, 69–71, 81; 446/268, 336, 483, 446/475, 71
See application file for complete search history.

(56) References Cited

U.S. PATENT DOCUMENTS

| | | | | |
|---|---|---|---|---|
| 1,914,938 | A | 6/1933 | Boninger | |
| 3,138,249 | A * | 6/1964 | Paulini | 116/2 |
| 4,251,947 | A | 2/1981 | Klawitter | 46/1 R |
| 5,449,324 | A * | 9/1995 | Sugawara | 472/69 |
| 5,536,209 | A * | 7/1996 | Suzuki | 472/69 |
| 6,267,639 | B1 * | 7/2001 | Menow et al. | 446/81 |

* cited by examiner

*Primary Examiner*—Kien Nguyen
(74) *Attorney, Agent, or Firm*—Robert W. J. Usher

(57) ABSTRACT

An illusion toy has a housing in which a blade is rotated in one direction too rapidly to be seen through 270 degrees between rest positions on respective opposite sides of an article receiving through hole, providing the illusion that the blade has rotated in an opposite direction across the through hole, through the article. An actuating lever for a blade rotating overcenter mechanism has a loop aligned with the through hole so that a trigger end of the lever can be visibly moved between opposite sides of the through hole in the same direction as the apparent movement of the blade. A hollow housing handle forms a candy dispensing store and connects to a delivery chute extending across the housing obscuring a radially outer portion of the blade path providing an impression that rotation of the blade in the one direction is blocked by candy.

26 Claims, 9 Drawing Sheets

ILLUSION TOY

RELATED APPLICATION

This application claims priority from provisional application 60/533,900 filed Jan. 2, 2004, the disclosure of which is incorporated herein by reference.

FIELD OF THE INVENTION

The invention relates to an illusion toy which creates an optical illusion that a blade passes completely through an article without actually severing the article.

BACKGROUND OF THE INVENTION

U.S. Pat. Nos. 1,914,938 and 4,251,947 issued, respectively, in 1932 to Boninger and in 1981 to Klawitter, teach examples of such illusion toys. The disclosures of both documents are incorporated herein by reference, Each patent teaches a pocket watch-shape housing in which a blade in a front, windowed compartment is rotated rapidly in one direction through an arc of more than 270 degrees between rest positions on opposite sides of a through hole by a spring-biased overcenter mechanism hidden from view in a rear compartment, the blade movement being triggered by a short arcuate movement of a trigger end of an actuating lever protruding visibly from a side wall of the rear compartment, adjacent the through hole. An article modeled as a person's head (or a pin) is removably mounted with a neck thereof extending into the through hole protruding visibly through the upper compartment into the lower compartment transversely through a plane of rotation of the blade.

As start and finish positions of the short arcuate movement of the visible trigger end portion of the actuating lever are on the same opposite sides of the through hole and head/pin as the start and finish positions of the blade and, as the blade moves too quickly to be seen, the illusion is created that the blade also has moved only a short arcuate distance in the same direction as the trigger end portion of the actuating lever and, as a result, across the through hole and through the article but, astonishingly, without severing the article. In fact, the blade has not rotated the short distance across the through hole but, in an opposite direction, through the much longer complementary arc of at least 270 degrees.

Although illusion toys of the type taught by the patents noted above have been widely sold for many years they suffer from several disadvantages.

For example, the references teach location of the through hole radially inwardly of the pivotal mounting of the actuating lever or, coincidently with the pivotal mounting of the actuating lever which cannot clearly create an impression of the actuating lever actually passing across the through hole during pivotal movement to trigger the overcenter mechanism to rotate the blade.

An additional disadvantage arises from the patent teaching that the article 'to be severed' should not extend completely through the housing so as to visibly protrude from the rear face and, that the article is small both and inanimate, resulting in some spectators immediately suspecting that the article does not actually cross the plane of movement of the blade. A significant increase in the size of the article is precluded as the patents teach that the article receiving through hole actually passes through the part of the housing containing the mechanism, (the through hole actually passing through the aperture in the yoke or quadrant gear), precluding significant enlargement relative to the existing size of the housing.

Furthermore, the front compartment in which the blade rotates is entirely circular, visibly providing the same clearance for rotation of the blade in all directions, enabling an analytical spectator to recognize the possibility of the blade moving away from the article receiving through hole, through the much longer arc, in an opposite direction to the visible trigger end and, therefore, not crossing the article receiving through hole at all.

A further disadvantage of the entirely circular shape of the housing is that it cannot be freestanding in a stable upright position for displaying the illusion.

In addition, the overcenter mechanisms are relatively complex and/or involve a higher than optimal inertia which limits the power available for blade rotation for a given spring strength, imposing an undesirable limitation on blade size, rotational speed and, as a result, the size of the article receiving through hole.

SUMMARY OF THE INVENTION

It is an object of the invention to obviate or ameliorate the above noted disadvantages thereby to provide an illusion toy which is provides an even more convincing illusion and which easier to manufacture in any selected size and with fewer moving parts.

According to the invention, the article receiving through hole is formed in a portion of the housing remote from the overcenter mechanism, and the actuating lever extends across the housing from the location of the overcenter mechanism, past the through hole and through a side wall of the housing remote from the mechanism and is formed with a bight which is aligned with the article receiving through hole in all positions of the actuating lever so that the actuating lever never actually crosses the through hole. Thus, as a result of its nonlinear shape, the actuating lever can extend from the visible trigger portion outside the housing side across a majority of the housing for pivotal mounting at a location on an opposite side of the through hole from the visible trigger portion, that is between the through hole and an opposite side of the housing while also clear of the through hole.

This provides an impression that the actuating lever actually sweeps across the through hole in close proximity to the blade, creating a compelling illusion of the blade moving across the through hole when the overcenter mechanism is triggered. Furthermore, separating the article receiving through hole from the overcenter mechanism enables it to be made sufficiently large to receive a person's finger extending completely through the housing so as to be clearly visible protruding from front and rear faces of the housing which obviates any suspicion as to whether the article actually crosses the plane of blade movement.

According to another aspect of the invention, the illusion that the blade moves completely across the article receiving through hole aperture is reinforced by a portion of the housing side wall extending in the quadrant containing the article receiving through hole and the start and finish positions of the visible trigger portion of the actuating lever and the blade being arcuate but opposed portions of the housing side wall extending away from such quadrant being non arcuate and of reduced separation from each other providing the optical illusion to the casual spectator that there is insufficient clearance with the side wall for the blade to rotate between start and stop (rest) positions in the opposite direction, through 270 degrees, away from the article receiving through hole, where the blade would not sweep across the article receiving through hole.

The window may extend only over a portion of the front compartment subtended by the arcuate edge portion to reveal the through hole and finger extending therethrough and the rest (stop and start) positions of the blade, with a majority of the the actual blade movement being hidden by a remaining opaque portion of the housing cover.

The impression that there is much greater space for movement of the blade across the arcuate region is increased by marking the housing surface in the arcuate area formed with the through hole and behind the rest positions of the blade with radially extending, colored bands which expand in width as they extend radially outward. The bands appear to emanate from an apparent pivot point for the sword as represented by a colored blob marked on a boss shape portion of the housing at a lower peripheral edge of the window so as to conceal the true pivot point which is in fact spaced further from the arcuate edge of the housing than the actual pivot point of the blade which results in an, at least fleeting, impression that the sword is pivoted at the apparent pivot point and is of therefore of greater length than the actual length, enhancing the impression of insufficient clearance for rotation in a direction way from the through hole.

The sword can also have a zig-zag (or other, non linear) shape with an innermost visible portion spaced a small distance from the pivot extending in the direct of the blob which also enhances the impression of the blade extending from a pivot which is spaced apart further from the arcuate edge of the housing and, therefore, of the sword being longer than the true length.

The invention provides a compact and simple operating mechanism. For example, the gear teeth are located on the outside surface of the rack segment results in the mass of the ear material being closer to the pivot point that where the gear teeth are on the inside surface of the rack segment as taught by Klawitter resulting in a lower moment of inertia and commensurately greater speed of blade movement for a given spring strength enabling an increase in blade size commensurate with a larger article such as a finger to be inserted in the through hole.

Advertising messages may be displayed on the front surface of the partition, behind the blade for enhanced impact and retention by association with the spectator's astonishment by the illusion.

According to another aspect of the invention, the housing further comprises means for dispensing candy. Preferably, the means for dispensing candy extends in front of and obscures a radially outer portion of a rotational path of the blade so as to provide an impression that rotational movement of the blade in a direction away from the through hole would be blocked by the presence of the candy, thereby enhancing the illusion that the blade has rotated across the article receiving through hole. The means for dispensing candy may comprise a hollow handle storing candy communicating with a candy delivery chute extending in front of and obscuring a radially outer portion of a rotational path of the blade.

According to a further aspect of the invention, the trigger end portion of the actuating lever comprises a writing implement.

According to another aspect of the invention, the partition has a front surface carrying a graphic behind the blade depicting a figure in a blade holding position, the figure having a center offset further away from the through hole than the shaft of rotation of the blade and the shaft being located intermediate longitudinal ends of the blade so as to provide a fleeting illusion that a pivotal center of the blade is located at the center of the figure further away from the through hole. Preferably, the blade comprises a sword with a handle and profiles of sword holding hands are marked on the handle at a location aligned with to the center of the figure thereby to enhance the illusion that a pivotal center of the blade is located at the center of the figure further away from the through hole.

BRIEF DESCRIPTION OF THE DRAWINGS

In order that the invention may be readily understood, specific embodiments thereof will now be described by way of example only and with reference to the accompany drawings in which.

DESCRIPTION OF PARTICULAR EMBODIMENTS

Figure 1:
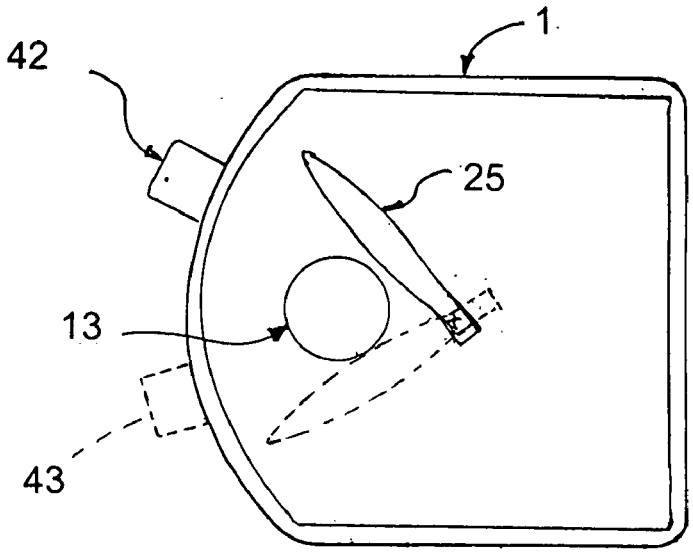
FIG. 1 is a front view of a first embodiment.

As shown in FIGS. 1–4, the first embodiment of amusement device includes a housing 1 comprising a central frame or chassis 2 molded in one piece of opaque plastic with a tubular side wall 3 divided internally by a medial partition 4 into front and rear compartments 5 and 6, respectively, closed by front and rear covers 7 and 8, respectively, the front cover 7 being transparent so as to provide a window for the front compartment, and the rear cover 8 being opaque. Through holes 13, 14 and 15 are formed in alignment in the covers and medial partition wall 4 aligned in the assembled housing so as to permit a person's finger to be inserted therethrough, passing completely through the housing. Three adjacent side wall portions 16*a*, 16*b* and 16*c* are essentially flat and the fourth 16*d* is arcuate. Edge portions of the covers are similarly shaped to fit thereon.

A pivot post 18 and a semi-cylindrical pivot protuberance 19 (FIG. 2) are molded on a rear side of the partition 4 and on an inside surface of wall portion 16*b*, respectively. A rear edge portion of the curved sidewall 16*d* has a rebate 20 providing an actuating lever access slot and abutments 21 (FIG. 2) are molded at opposite locations on opposite interior surfaces sides of opposite side wall portions 16*a* and 16*c*. A stub shaft receiving through hole 23 is provided in the partition wall 4.

Figure 2:
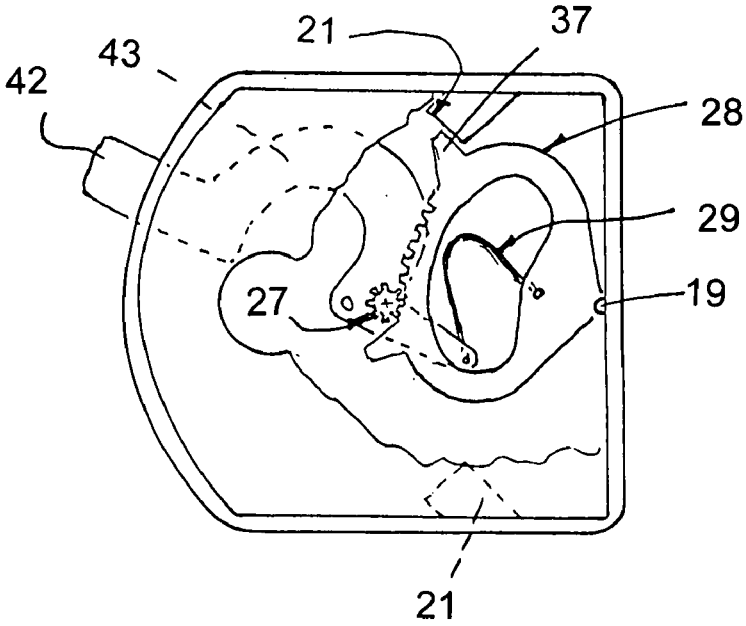
FIG. 2 is a similar view to FIG. 1, partly cut away to reveal the operating mechanism.
Figure 4:
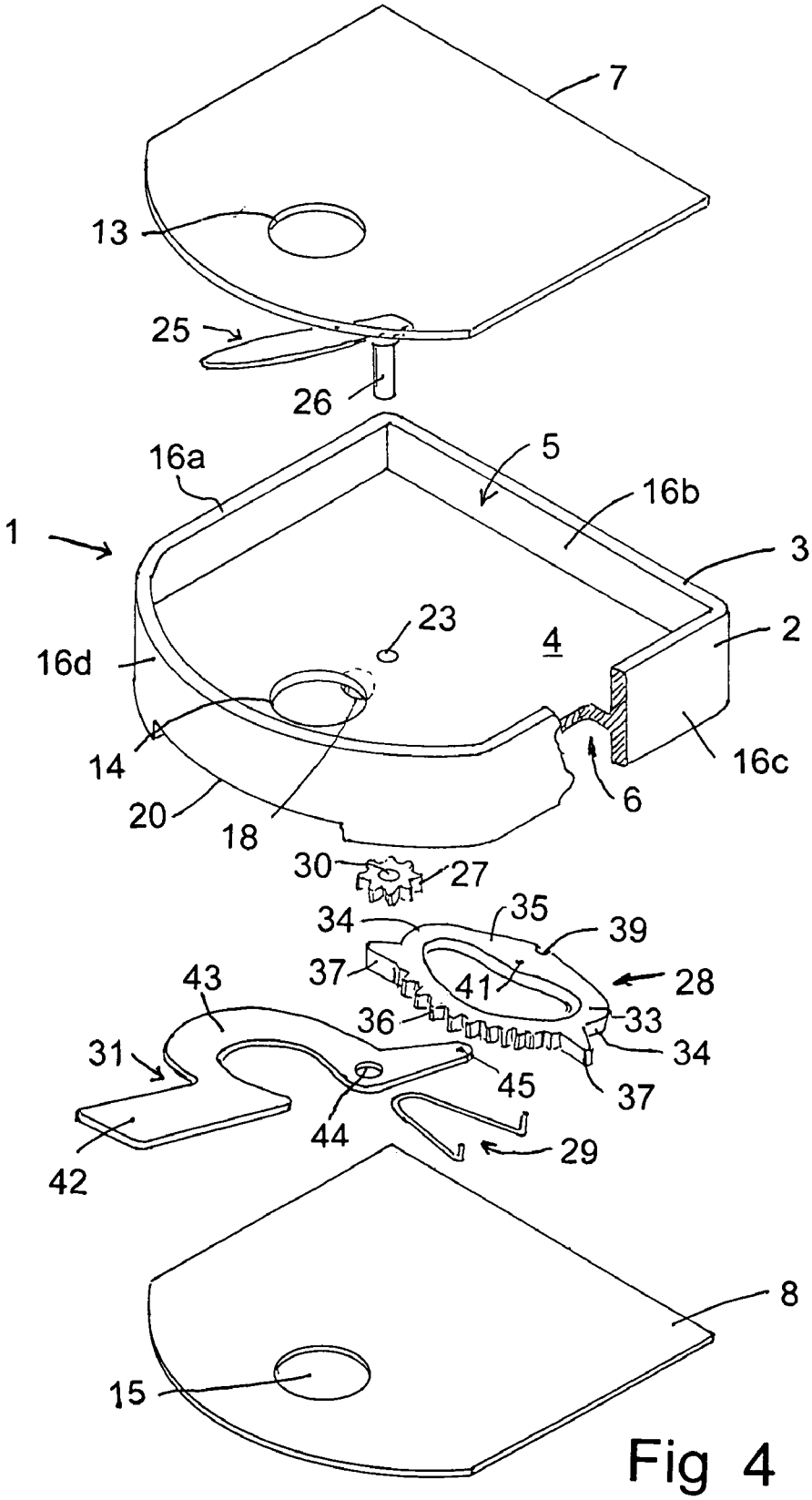
FIG. 4 is an exploded view of the first embodiment.

As seen most clearly in FIG. 2 and FIG. 4, the operating mechanism comprises a 'blade' or 'wand' 25 having a radially extending stub shaft 26, a pinion gear 27 with a stub shaft receiving bore 30, a rack gear segment 28, a hairpin spring 29 and an actuating lever 31.

The gear segment 28 is part of a quadrant yoke 33 which comprises a pair of arms 34 extending from a base land 35 to opposite ends of an arcuate, externally toothed, rack 36 from opposite ends of which stop members 37 project. The base land 35 has a notch bearing 39 and a through hole 41 spaced inwardly therefrom along a medial axis for pivotally anchoring an upturned end of one arm of the hairpin spring 29.

The actuating lever 31 comprises a finger piece or trigger portion 42 joining a looped portion or bight 43, a pivot aperture 44 and an anchoring aperture 45 for pivotally anchoring the other upturned end of the hairpin spring 29.

It will be noted that, the central frame or chassis together with the operating mechanism consist of only 6 separate parts.

As shown in FIG. 2, in the assembled state, the blade is rotatively mounted in the front compartment by insertion of the stub shaft 26 through the hole 23 and the lower end fixed in bore 30 of the pinion gear 27. The rack 36 of gear segment 28 is meshed with the pinion gear 27 with the notch bearing 39 receiving, pivotally, the protuberance 19. The actuating arm is pivotally mounted behind the rack and pinion by receipt of the pivot post 18 in the pivot aperture 44 and the upturned ends on the arms of the hairpin spring 29 pivotally anchored in anchoring holes 41 and 45, respectively, of the base land 35 of the gear segment 28 and the inner end of the actuating lever 31.

Figure 3A:
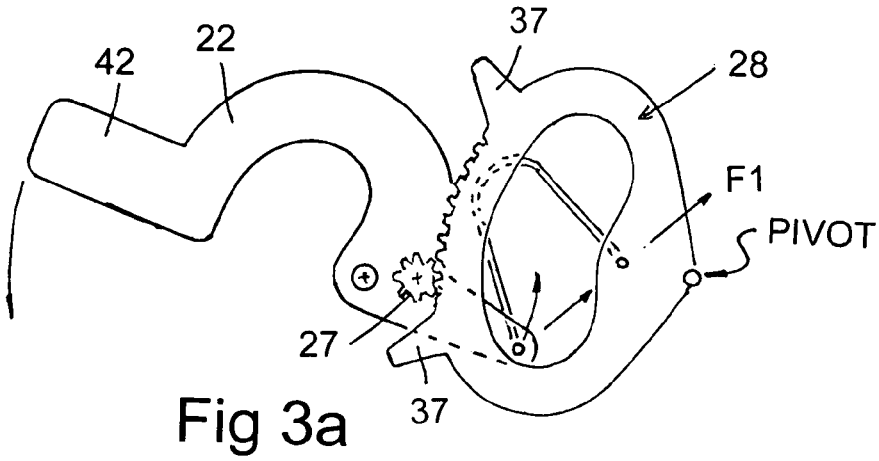
FIGS. 3*a*, 3*b* and 3*c* are schematic views of the operating mechanism in successive stages of operation.
Figure 3B:
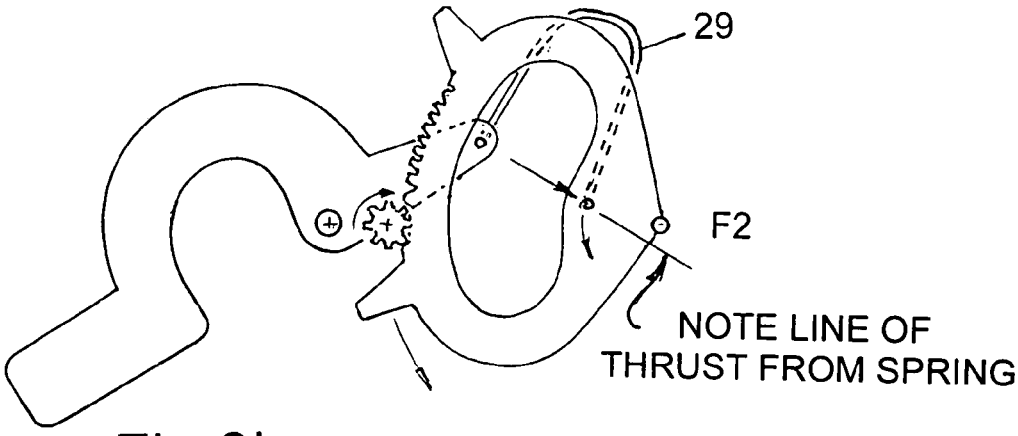
Figure 3C:
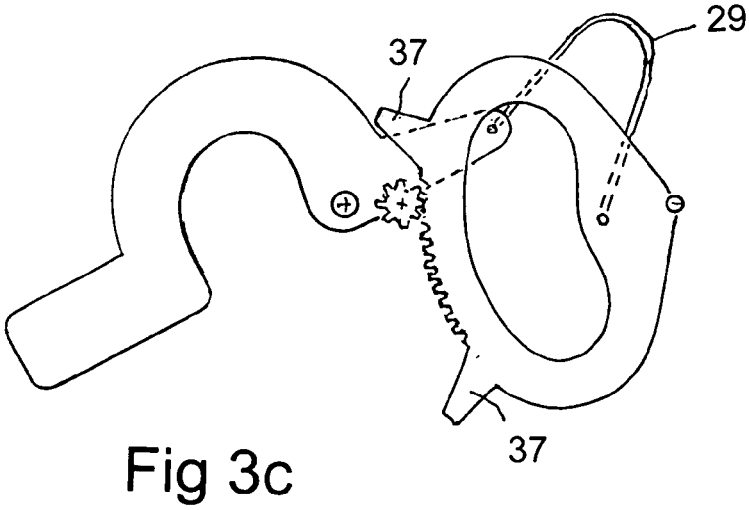

In operation of the toy, as most clearly seen in FIG. 1 and FIGS. 3*a*–3*c*, the magician inserts his own, (or a willing spectator's), finger into through holes 13, 14 and 15 so that the finge, (not shown), extends completely through the housing and can be seen protruding from front and rear faces. The mechanism will be in the position shown in FIG. 1 and FIG. 3*a*. The magician then pushes the exposed trigger 41 anticlockwise, (in the direction of the arrow in FIG. 3*a*), which progressively urges the arm of the hairpin secured to the inner end of the actuating lever toward the other arm, progressively tensioning the spring while pivoting the spring anticlockwise. The gear segment 28 and pinion gear 27 remain stationary throughout the initial stages of movement of the actuating lever with the gear segment 28 remaining biased by the increasing spring tension in the most clockwise (uppermost) position, as the line of thrust F1 is above the pivot point of the gear segment 3. However, with further progressive clockwise movement of the lever, the line of thrust from the hairpin spring will move clockwise to an overcenter position just below (and anticlockwise) relative to the fulcrum or pivot point of the gear segment, as shown in FIG. 3*b*, when the increased spring tension will cause the gear segment to suddenly pivot counter-clockwise very rapidly, with a snap action, to the position shown in FIG. 3*c*, the rack teeth 36 rapidly rotating the pinion gear 27 and blade 25 clockwise through approximately 270 degrees to bring the blade 25 and the trigger 42 to the opposite side of the through hole 13, (to which position the trigger will have been moved), faster than the eye can see, as shown in broken lines in FIG. 1. Movement of the segment gear in either direction is arrested by impact of a stop member 37 with the abutment 21 with the production of a loud rap, as the abutments 21 are solid with the wall of the housing, which noise adds to the startling effect on the spectator.

Subsequent movement of the trigger 42 in the opposite direction will effect corresponding counterclockwise rotation of the blade.

The spectators perception is influenced by the arcuate shape of the adjacent housing portion 16*d*, the movement of the visible trigger which is adjacent the blade from one side of the through hole (and finger) to the other and the apparent movement of an inner, hidden, extended portion of the trigger completely across the through hole, to experience the illusion that the blade has passed through the finger without severing the finger. The impression that the blade moves across the through hole and not in the other direction is enhanced by the impression of reduced or insufficient clearance for rotation of the blade away from the through hole arising from the change from a curved to a straight wall and more confining wall portion.

The flat form of the wall portions 16*a*, 16*b* and 16*c* enables the housing to be freestanding thereon for presenting a trick. Alternatively, the toy is sufficiently small to be hand held.

Figure 6:
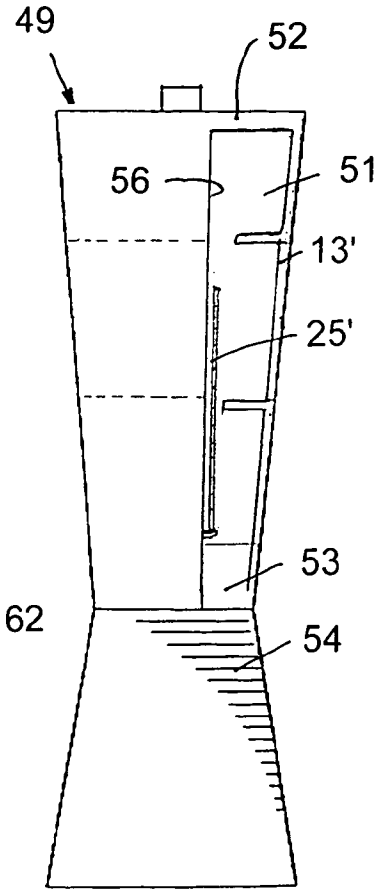
FIG. 6 is a side view of the housing shown in FIG. 5.
Figure 5:
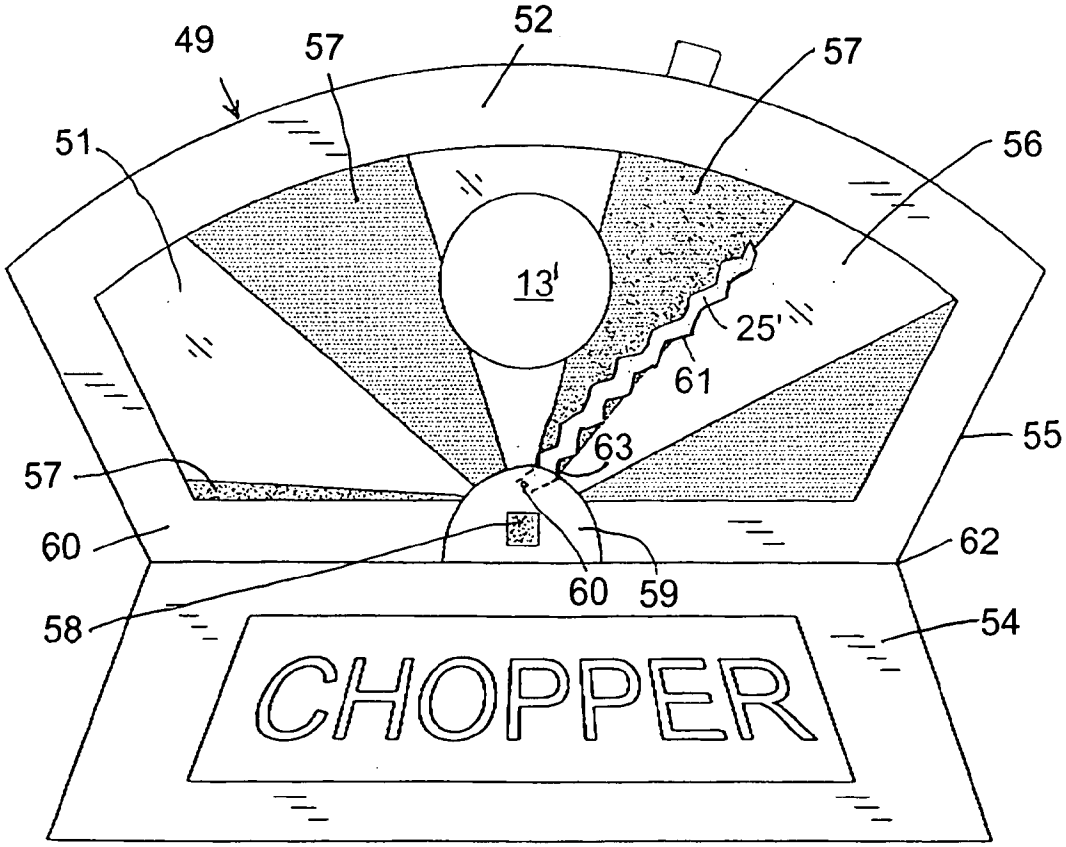
FIG. 5 is a front view of a housing of a second embodiment.

The housing 49 of the second embodiment shown in FIGS. 5 and 6 differs from the housing of the first embodiment in that the only the upper portion 51 of the front compartment adjacent the arcuate wall portion 52 is windowed, the remainder 53 is hidden from the spectator's view by an opaque front cover portion 54. Furthermore, instead of straight, parallel opposite side wall portions extending away from the arcuate wall portion the housing is waisted with opposite side wall portions 55 which extend inward from opposite ends of the arcuate portion and then outward to define a part 62 of minimum width at the bottom of the windowed portion 51, which provides minimum sufficient clearance for blade rotation. The housing is also waisted in the transverse direction to reinforce an impression that the central portion is too narrow to admit passage of the blade therethrough. The surface of the portion 56 of the partition behind the windowed portion 51 revealing the through hole and blade 25' is marked with upwardly/radially outwardly divergent contrastingly colored bands 57 of expanding width which appear to emanate from a similarly colored blob 58 marked centrally on a boss shaped portion 59 located on the front cover 60 at the apparent center of the arcuate wall portion.

The impression that there is much greater space for movement of the blade 25' across the arcuate region is increased by the expanding bands. The bands appear to emanate from an apparent pivot point for the sword as represented by the colored blob marked on a boss shape portion of the housing at a lower peripheral edge of the window so as to conceal the true pivot point 60 which is in fact spaced further from the arcuate edge of the housing than the actual pivot point of the blade which results in an, at least fleeting, impression that the sword is pivoted at the apparent pivot point and is of therefore of greater length than the actual length, enhancing the impression of insufficient clearance for rotation in a direction away from the through hole.

The sword has a zig-zag (or other, non linear) edge 61 with an innermost visible portion 63 spaced a small distance from the pivot extending in the direct of the blob 58 which also enhances the impression of the blade extending from a pivot which is spaced apart further from the arcuate edge of the housing and, therefore, of the blade being longer than the true length and unable to rotate away from the through hole past the waisted portion.

In the third, candy dispensing, embodiment, shown in FIGS. 7*a*-10, as the operating mechanism is similar to the prior embodiments, corresponding elements are identified by primed reference numerals.

This embodiment has a depending pistol grip handle 70 providing a candy store/reservoir communicating with a candy dispensing chute 72 which extends upwards, in front of, the outer portion of the actual rotational path of the blade 25', to a (capped) dispensing opening 78 at a top side remote from a finger receiving through hole 13'.

Figure 9:
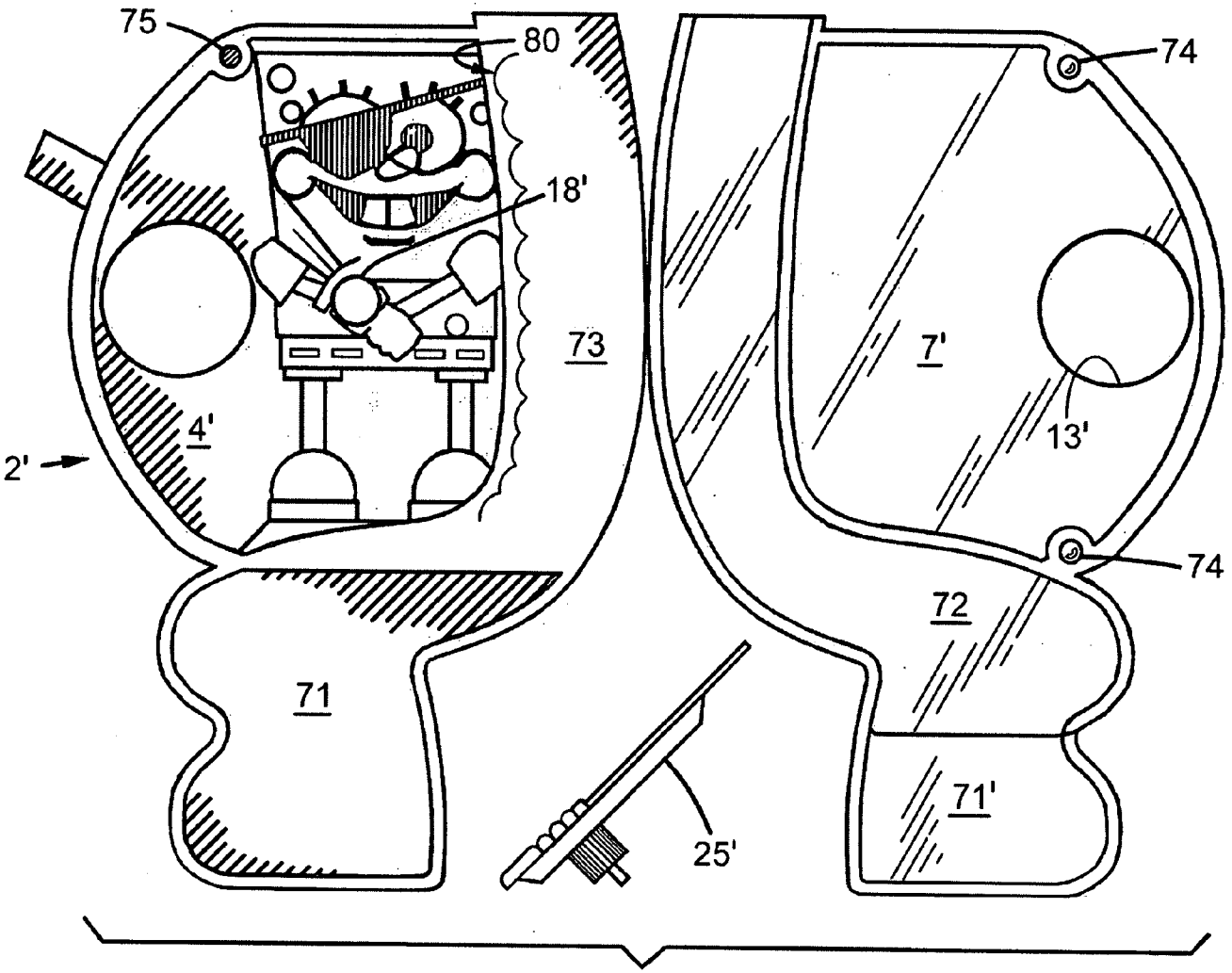
FIG. 9 shows a front compartment of a prototype molded part forming the housing frame with the art work thereon; a blade and pinion assembly, and an inside of a transparent front cover for the housing frame.
Figure 10:
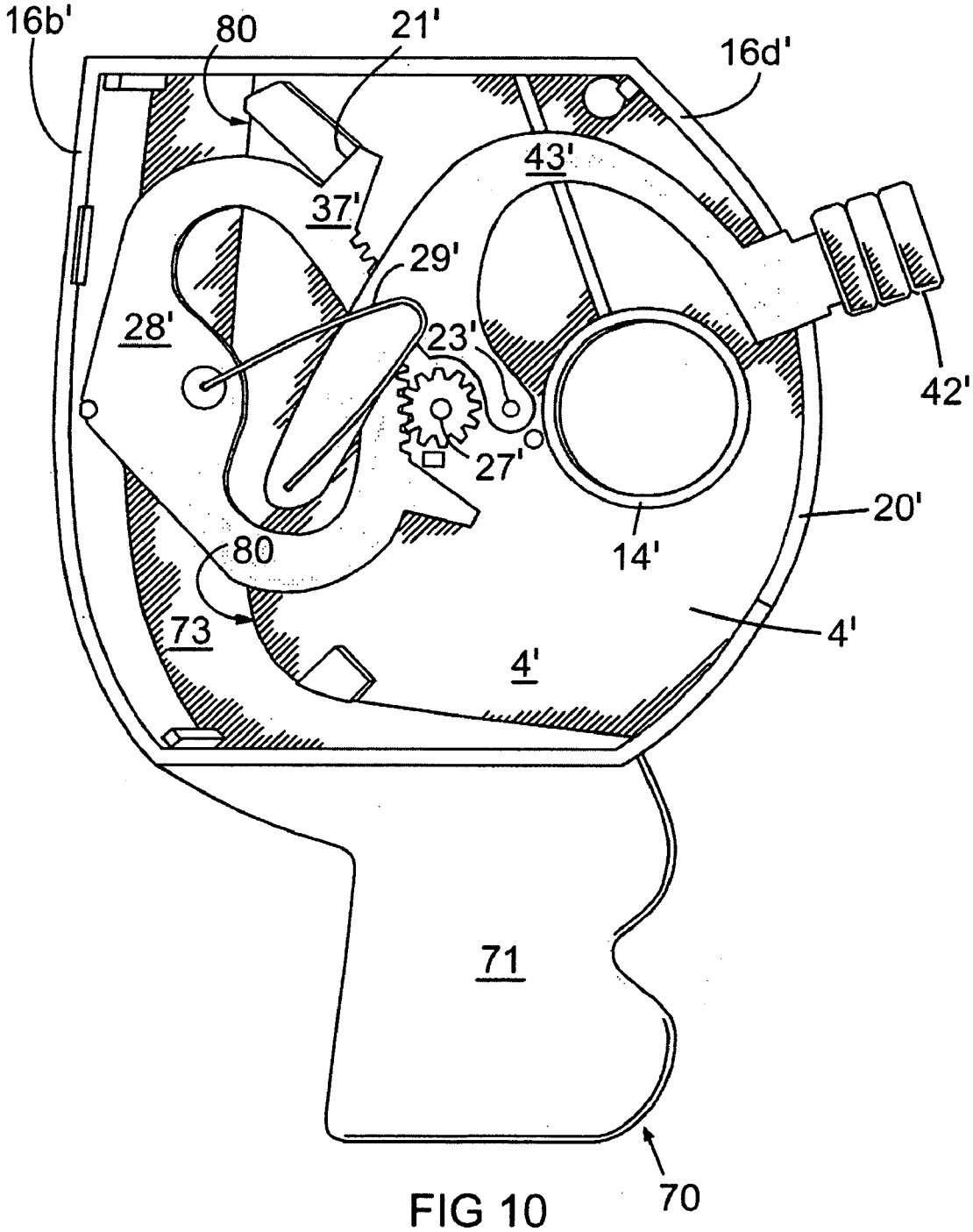
FIG. 10 shows the rear compartment of the frame with the operating mechanism assembled therein. and, FIGS. 11*a* and 11*b* are front views of a fourth embodiment in which the finger piece or trigger of the actuating lever is formed by a pen.

The housing frame 2' and front, transparent cover 7' are modified in being integrally molded with hollowed, pistol grip handle halves 71,71', respectively, the half 71 depending from a front of a lower sidewall 16*d'* of the housing frame 2' and the half 71' communicating with an upwardly extending channel 72 formed in the front cover 7' As can be seen in FIG. 10, the medial partition extends from the wall 16*d'* across a majority of the frame 2' but terminates short of the wall 16*b'* and short of a majority of the wall 16*c'*. As seen in FIG. 9, another, wall portion 73, shorter than the partition 4', extends from the wall 16*b'* in a plane forward of and parallel to the partition 4' providing a gap 80 therebetween for admitting the blade during rotation.

Figure 7A:
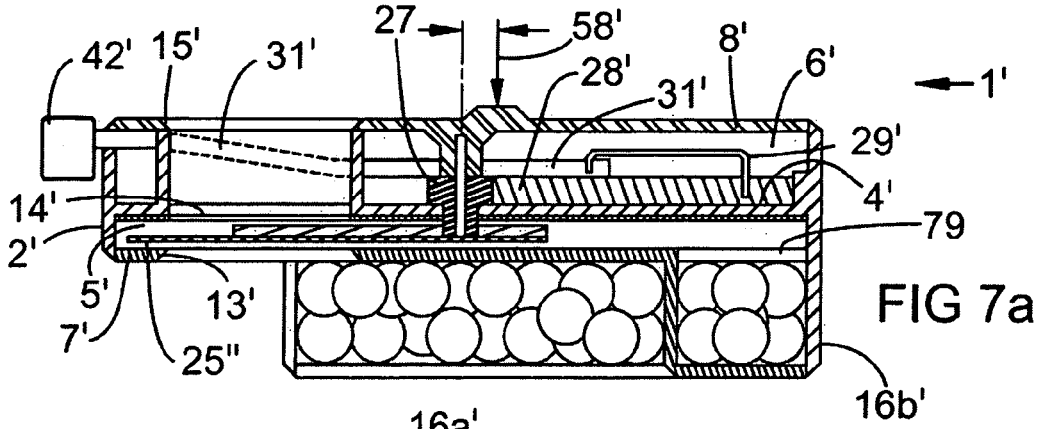
FIGS. 7*a* and 7*b* are, respectively, a diagrammatic top plan view and a front view of a third embodiment, which dispenses candy.
Figure 7B:
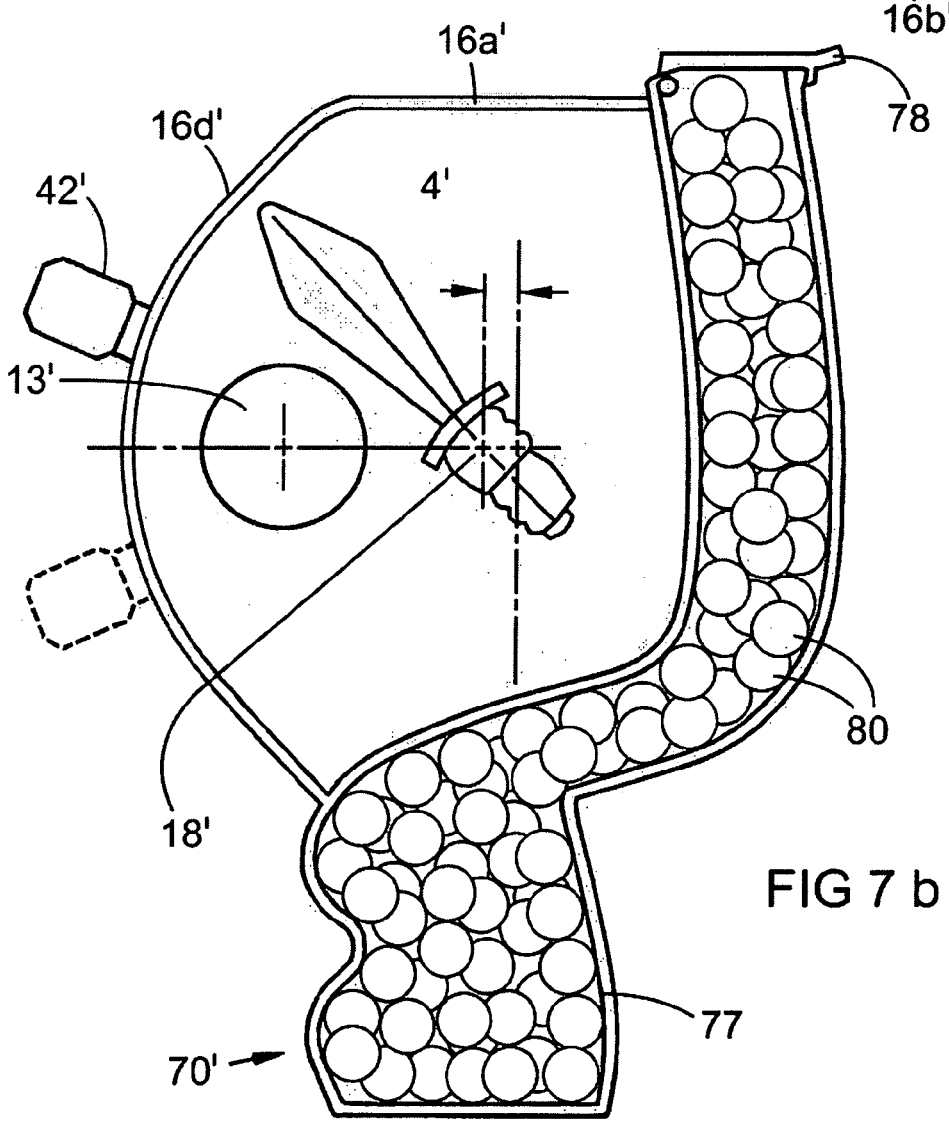
Figure 8:
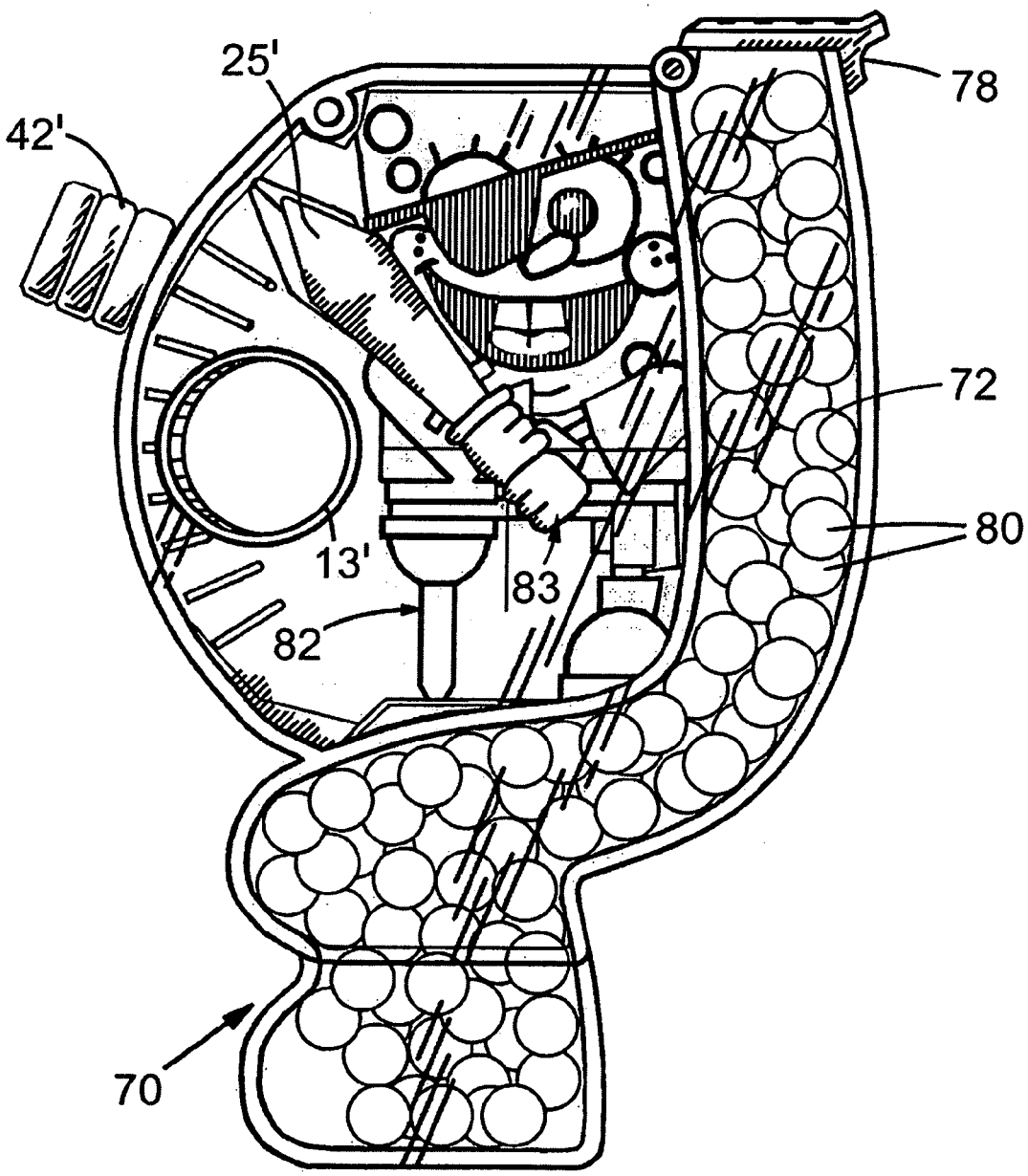
FIG. 8 is a photograph of a prototype of the third embodiment

The cover 7' has a complementary profile to the frame 2' and is assembled thereto by receipt of pegs 74 in frame sockets 75 so that the handle halves cooperate to provide the candy receiving reservoir 77 and the opaque wall 73 of the frame 2' engages over the channel 72 of the front cover to form the candy dispensing chute, as shown in FIG. 8, (which differs from the schematic of FIG. 7*a* where the opaque rear wall of the chute is shown at 79).

When so assembled, the candy dispensing chute containing flowable candy 80 extends across the front compartment 5' in front of part of the actual path of rotation of the sword so that the sword rotates behind the candy chute. This further reinforces the impression that there is insufficient clearance for the sword to rotate in a clockwise direction, away from the finger receiving through hole, enhancing the illusion.

The rear cover 8' is formed with a protuberance 58' which is displaced rearward away from the actual pivot point of the sword which cannot be seen, providing the impression on casual inspection that the protuberance coincides with the actual pivot point and that there is insufficient clearance for the sword to rotate clockwise.

The front surface of the partition 4' is marked with a graphic 82 depicting a figure positioned to hold the sword form blade, (enhanced by molding hand profiles 83 on the sword handle), the sword holding position/center of which figure is offset to the rear (right) of the actual pivot hole 23' for the sword. As there is often a tendency for a casual observer to presume that the pivot point for the sword will coincide with the position at which the sword is held, the impression is given that the pivotal position of the sword is too close to the right side of the housing to permit clearance for clockwise sword rotation and that the sword is of greater than actual length, enhancing the impression of insufficient clearance for clockwise rotation.

Although, for some spectator's, a macabre impression is most stimulating, for others, the provision of the candy provides a softer, more toy like impression.

Figure 11A:
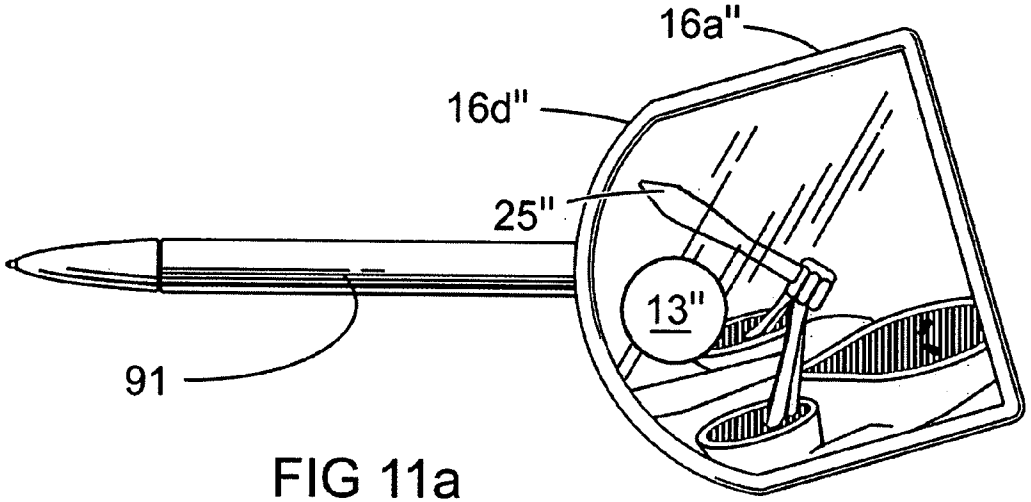
Figure 11B:
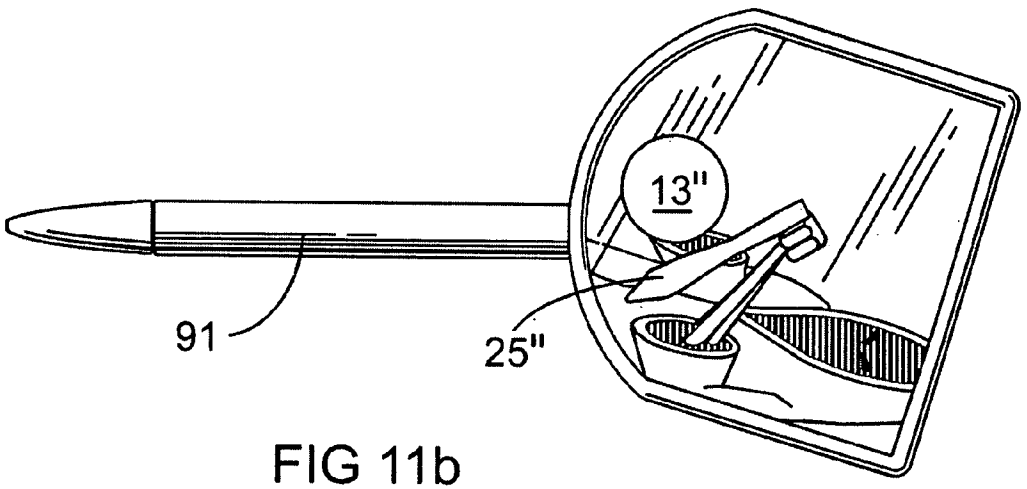

In a modification, shown partly in FIG. 11, the blade, stub shaft and pinion gear are molded in one piece and retained in a through hole 23', enlarged to permit insertion of the pinion by sliding engagement of the blade with the front cover, thereby reducing the number of parts for economical mass production and increasing the durability as obviating any tendency for a separately formed metal pivot to separate from the pinion.

A dispensing mechanism for any suitable item can replace the candy dispensing reservoir and chute such as a bubble maker/blower, a cigarette lighter etc., overlying an extreme portion of the actual rotational path of the blade so as to provide the fleeting impression to a casual observer that the blade would be prevented from clockwise rotation by impacting such items or functional mechanism.

In the fourth embodiment, shown in FIGS. 12 *a* and 12 *b*, the finger piece or trigger of the actuating lever is formed by a pen 91. Pen movement to actuate the operating mechanism to rotate the blade 25" also causes reciprocation of the pen nib between advanced, writing and withdrawn, storage positions.

The invention claimed is:

1. An illusion toy comprising a housing having a side wall defining a bounded area, said side wall having an elongate slot extending perimetrically, a windowed front cover coextensive with said bounded area, said cover being formed with an article receiving through hole, a partition spaced rearward of said front cover defining therewith and with the side wall, a front compartment and, a rear cover defining with said side wall and partition a mechanism compartment concealed behind said partition, said partition and said rear cover having respective through holes aligned with the though hole on said front cover, said partition having a shaft opening in it, offset from the through holes, and an illusion producing mechanism having a shaft extending perpendicularly to said partition through said shaft opening into the front compartment, said shaft carrying at a front end a blade extending parallel to said partition and extending radially from said shaft a distance greater than the distance between the shaft and said article receiving through hole, a pinion connected to a rear end of said shaft and axially aligned therewith, an arcuate segment rack engaging said pinion, an elongate actuating lever pivotally mounted between its longitudinal ends in the rear compartment and having an outer trigger forming end projecting through and beyond said sidewall slot out from the housing and an inner end with means for anchoring a spring, and overcenter means operatively connected to said lever and said segment rack for rapidly and suddenly displacing said rack in response to movement of said lever through a given arc past an overcentered position, whereby said pinion, shaft, and hence said blade is rotated too rapidly to be seen through at least 270 degrees from a rest position on one side of said article receiving through hole to a rest position to the other side thereof, said overcenter means comprising a quadrant yoke mounted on a pivot within said rear compartment, said quadrant yoke having arms between outer ends of which the segment rack extends and having means for anchoring a spring at a location spaced apart from the pivot, and a spring having one end mounted by the spring anchoring means of the actuating lever and its other end by the spring anchoring means on said quadrant yoke, the improvement residing in that:

the actuating lever arm is pivotally mounted at a location further away from the trigger forming end than the article receiving through hole and is formed with a loop at a location adjacent the through hole so that the actuating lever extends across the rear compartment past the through hole without crossing the through hole in all operative positions but appears to have crossed the article receiving through hole to a spectator viewing the trigger forming end during movement to opposite sides of the article receiving through hole to actuate the overcenter mechanism, enhancing an illusion that the blade has also moved across the article receiving though hole.

2. An illusion toy according to claim 1 wherein the spring is a hairpin spring and has spring arms with upturned free ends and the anchoring means on the actuating lever and quadrant gear comprise respective anchoring holes receiving respective upturned ends.

3. An illusion toy according to claim 1 wherein teeth of the segment rack are located along an outer circumference thereof, remote from the pivot.

4. An illusion toy according to claim 1 wherein the article receiving though hole is sized for receiving a person's finger extending completely through the housing so as to be clearly visible, protruding from front and rear faces of the housing.

5. An illusion toy according to claim 1 wherein a portion of the housing side wall extending in a quadrant containing the article receiving through hole and between rest positions of the visible trigger portion of the actuating lever and the blade on opposite sides of the article receiving through hole is arcuate, but opposed portions of the housing side wall extending away from such quadrant are non arcuate and of reduced separation, providing an optical illusion to the casual spectator that there is insufficient clearance with the opposed portions of the housing side wall for the blade to rotate between rest positions, away from the article receiving through hole, in which the blade would not sweep across the article receiving through hole.

6. An illusion toy according to claim 5 wherein the windowed front cover is transparent over only a portion of the front compartment adjacent the arcuate portion of the side wall to reveal only the through hole and an article extending therethrough and rest positions of the blade on respective opposite sides of the through hole so that a portion of actual rotational blade movement remote from the through hole is hidden behind an opaque portion of the housing.

7. An illusion toy according to claim 6 wherein a surface portion of the partition visible through the windowed front cover in the quadrant is formed with the through hole and behind the rest positions of the blade is marked with radially extending, colored bands which expand in width as they extend radially outward to increase the apparent size of such surface portion.

8. An illusion toy according to claim 7 wherein the front cover of the housing has a boss shape portion at a lower peripheral edge of the transparent portion and a colored blob representing an apparent pivot point for the sword is marked thereon at a central location corresponding to the geometric center of the arcuate portion whereas the blade is pivotally mounted at an actual pivot point located closer to the arcuate side wall than the blob and concealed behind the boss and the bands appear to emanate from the blob thereby providing an, at least fleeting, impression that the pivot point of the blade coincides with the blob and that the blade is therefore of greater length than an actual length of the blade, enhancing the impression of insufficient clearance for blade rotation in a direction way from the through hole.

9. An illusion toy according to claim 8 wherein the blade has a longitudinal edge protion one of a zig-zag and other, non linear shape, with a radially innermost visible portion spaced a small distance from the pivot extending in the direct of the blob which enhances the impression of the pivot point of the blade being coincident with the blob and, therefore, of the sword being longer than an actual length.

10. An illusion toy according to claim 6 wherein said opaque portion of the housing forms as a rear wall of one of a store of dispensable items and a functional mechanism overlying an extremity of the rotational path of the blade and visible to a spectator through the front cover.

11. An illusion toy according to claim 10 wherein said dispensable items comprise candy.

12. An illusion toy according to claim 11 wherein said store is formed by a handle and an item dispensing chute formed by said front cover.

13. An illusion toy according to claim 5 wherein abutments are molded at opposite locations on interior surfaces sides of said housing and stop members project from respective opposite ends of the rack which stop members impact respective abutments at the end of blade rotation, producing a loud noise.

14. An illusion toy according to claim 1 wherein gear teeth are located on an outside surface of the rack segment remote from the pivot point of the segment gear.

15. An illusion toy according to claim 1 wherein a surface of the partition behind the blade and adjacent the article receiving through hole provides a display surface for advertising messages for viewing through the windowed cover, thereby to increase their impact by association with the illusion.

16. An illusion toy according to claim 1 wherein the trigger of the actuating lever comprises a writing implement.

17. A combined illusion toy and candy dispenser comprising a housing having a side wall defining a bounded area, said side wall having an elongate slot extending perimetrically, a windowed front cover coextensive with said bounded area, said cover being formed with an article receiving through hole, a partition spaced rearward of said front cover defining therewith and with the side wall, a front compartment and, a rear cover defining with said side wall and partition a mechanism compartment concealed behind said partition, said partition and said rear cover having respective through holes aligned with the through hole on said front cover, said partition having a shaft opening in it, offset from the through holes, and an illusion producing mechanism concealed in the mechanism compartment having a shaft extending perpendicularly to said partition through said shaft opening into the front compartment, said shaft carrying at a front end a blade extending parallel to said partition and extending radially from said shaft a distance greater than the distance between the shaft and said article receiving through hole, an elongate actuating lever pivotally mounted in the rear compartment and having an outer, trigger forming end projecting through and beyond said sidewall slot out from the housing and an inner end operatively engaging the mechanism whereby manually moving the trigger causes said mechanism to rotate said shaft, and hence said blade rapidly through at least 270 degrees from a position on one side of said article receiving through hole, away from said through hole, to a position to the other side thereof, while providing an illusion that the blade has rotated in an opposite rotational direction across the article receiving though hole, the housing further comprising means for dispensing candy.

18. A combined illusion toy and candy dispenser according to claim 17 wherein the means for dispensing candy extends in front of and obscures a radially outer portion of a rotational path of the blade so as to provide an impression that rotational movement of the blade in a direction away from the through hole would be blocked by the presence of the candy, thereby enhancing the illusion that the blade has rotated across the article receiving through hole.

19. A combined illusion toy and candy dispenser according to claim 18 wherein the means for dispensing candy comprises a hollow handle storing candy communicating with a candy delivery chute extending in front of and obscuring a radially outer portion of a rotational path of the blade.

20. A combined illusion toy and candy dispenser comprising a housing having a front, windowed compartment in which a blade is rotated too rapidly to be seen in one direction through an arc of more than 270 degrees between rest positions on opposite sides of an article receiving through hole by a mechanism concealed in a rear compartment of the housing, blade rotation being triggered by arcuate movement of a trigger end portion of an actuating lever which protrudes visibly from the rear compartment adjacent the through hole, with start and finish positions of the movement of the visible trigger end portion of the actuating lever being on same opposite sides of the through hole as start and finish positions of the blade, creating an illusion that the blade also has moved with the trigger end portion of the actuating lever in an opposite direction across the through hole, the housing further comprising candy dispensing means for holding candy extending across the housing in front of and obscuring a radially outer portion of a rotational path of the blade so as to provide an impression that rotational movement of the blade in a direction away from the through hole would be blocked by the presence of the candy, thereby enhancing the illusion that the blade has rotated across the article receiving through hole.

21. A combined illusion toy and candy dispenser according to claim 20 wherein wherein said candy dispensing means comprises a handle containing candy communicating with a candy dispensing chute.

22. An illusion toy of a type comprising a housing having a front, windowed compartment in which a blade is rotated too rapidly to be seen in one direction through an arc of more than 270 degrees between rest positions on opposite sides of an article receiving through hole by a mechanism concealed in a rear compartment of the housing, blade rotation being triggered by arcuate movement of a trigger end portion of an actuating lever which protrudes visibly from the rear compartment adjacent the through hole, with start and finish positions of the movement of the visible trigger end portion of the actuating lever being on same opposite sides of the through hole as start and finish positions of the blade, creating an illusion that the blade also has moved with the trigger end portion of the actuating lever in an opposite direction across the through hole, the improvement residing in that the trigger end portion of the actuating lever comprises a writing implement.

23. An illusion toy comprising a housing having a side wall defining a bounded area, said side wall having an elongate slot extending perimetrically, a windowed front cover coextensive with said bounded area, said cover being formed with an article receiving through hole, a partition spaced rearward of said front cover defining therewith and with the side wall, a front compartment and, a rear cover defining with said side wall and partition a mechanism compartment concealed behind said partition, said partition and said rear cover having respective through holes aligned with the through hole on said front cover, said partition having a shaft opening in it, offset from the through holes, and an illusion producing mechanism concealed in the mechanism compartment having a shaft extending perpendicularly to said partition through said shaft opening into the front compartment, said shaft carrying at a front end a blade extending parallel to said partition and extending radially from said shaft a distance greater than the distance between the shaft and said article receiving through hole, an elongate actuating lever pivotally mounted in the rear compartment and having an outer, trigger forming end projecting through and beyond said sidewall slot out from the housing and an inner end operatively engaging the mechanism, whereby manually moving the trigger causes said mechanism to rotate said shaft, and hence said blade too rapidly to be seen through at least 270 degrees from a rest position on one side of said article receiving through hole, away from said through hole, to a rest position to the other side thereof, while providing an illusion that the blade has rotated in an opposite rotational direction across the article receiving though hole;

wherein a portion of the housing side wall extending in a quadrant containing the article receiving through hole and between rest positions of the visible trigger portion of the actuating lever and the blade on opposite sides of the article receiving through hole is arcuate, but opposed portions of the housing side wall extending away from such quadrant are non arcuate and of reduced separation, providing an optical illusion to the casual spectator that there is insufficient clearance with the opposed portions of the housing side wall for the blade to rotate between rest positions, away from the article receiving through hole, in which the blade would not sweep across the article receiving through hole.

24. An illusion toy comprising a housing having a side wall defining a bounded area, said side wall having an elongate slot extending perimetrically, a windowed front cover coextensive with said bounded area, said cover being formed with an article receiving through hole, a partition spaced rearward of said front cover defining therewith and with the side wall, a front compartment and, a rear cover defining with said side wall and partition a mechanism compartment concealed behind said partition, said partition and said rear cover having respective through holes aligned with the through hole on said front cover, said partition having a shaft opening in it, offset from the through holes, and an illusion producing mechanism concealed in the mechanism compartment having a shaft extending perpendicularly to said partition through said shaft opening into the front compartment, said shaft carrying at a front end a blade extending parallel to said partition and extending radially from said shaft a distance greater than the distance between the shaft and said article receiving through hole, an elongate actuating lever pivotally mounted in the rear compartment and having an outer, trigger forming end projecting through and beyond said sidewall slot out from the housing and an inner end operatively engaging the mechanism, whereby manually moving the trigger causes said mechanism to rotate said shaft, and hence said blade too rapidly to be seen through at least 270 degrees from a rest position on one side of said article receiving through hole, away from said through hole, to a rest position to the other side thereof, while providing an illusion that the blade has rotated in an opposite rotational direction across the article receiving though hole;

wherein the windowed front cover is transparent over only a portion of the front compartment adjacent the arcuate portion of the side wall to reveal only the through hole and an article extending therethrough and rest positions of the blade on respective opposite sides of the through hole so that a portion of actual rotational blade movement remote from the through hole is hidden behind an opaque portion of the housing.

25. An illusion toy comprising a housing having a side wall defining a bounded area, said side wall having an elongate slot extending perimetrically, a windowed front cover coextensive with said bounded area, said cover being formed with an article receiving through hole, a partition spaced rearward of said front cover defining therewith and with the side wall, a front compartment and, a rear cover defining with said side wall and partition a mechanism compartment concealed behind said partition, said partition and said rear cover having respective through holes aligned with the through hole on said front cover, said partition having a shaft opening in it, offset from the through holes, and an illusion producing mechanism concealed in the mechanism compartment having a shaft extending perpendicularly to said partition through said shaft opening into the front compartment, said shaft carrying at a front end a blade extending parallel to said partition and extending radially from said shaft a distance greater than the distance between the shaft and said article receiving through hole, an elongate actuating lever pivotally mounted in the rear compartment and having an outer, trigger forming end projecting through and beyond said sidewall slot out from the housing and an inner end operatively engaging the mechanism, whereby manually moving the trigger causes said mechanism to rotate said shaft, and hence said blade too rapidly to be seen through at least 270 degrees from a rest position on one side of said article receiving through hole, away from said through hole, to a rest position to the other side thereof, while providing an illusion that the blade has rotated in an opposite rotational direction across the article receiving though hole;

wherein the partition has a front surface carrying a graphic behind the blade depicting a figure in a blade holding position, the figure having a center offset further away from the through hole than the shaft of rotation of the blade and the shaft being located intermediate longitudinal ends of the blade so as to provide a fleeting illusion that a pivotal center of the blade is located at the center of the figure further away from the through hole.

26. An illusion toy according to claim 25 wherein the blade comprises a sword with a handle and profiles of sword holding hands are marked on the handle at a location aligned with to the center of the figure thereby to enhance the illusion that a pivotal center of the blade is located at the center of the figure further away from the through hole.

* * * * *